United States Patent [19]

Waasner et al.

[11] Patent Number: 4,594,295

[45] Date of Patent: Jun. 10, 1986

[54] CUT SHEET METAL LAMINATION ELEMENT COMPRISED OF TWO PARTS AND HAVING THREE LEGS

[75] Inventors: Brüno Waasner, Bamberger Str. 85, Forchheim, Fed. Rep. of Germany, 8550; Rolf-Dietrich Waasner, Forchheim, Fed. Rep. of Germany

[73] Assignee: Bruno Waasner, Forchheim, Fed. Rep. of Germany

[21] Appl. No.: 611,857

[22] Filed: May 18, 1984

[30] Foreign Application Priority Data

May 20, 1983 [DE] Fed. Rep. of Germany ..... 3318370

[51] Int. Cl.[4] ..... H01F 27/26

[52] U.S. Cl. ..... 428/581; 428/582; 403/282; 29/445; 29/609; 336/210; 336/212; 336/216; 336/234

[58] Field of Search ..... 428/581, 582, 594; 336/212, 234, 210, 216, 217; 403/274, 282, 284; 29/445, 609

[56] References Cited

U.S. PATENT DOCUMENTS 3,803,479 4/1974 Rathor ..... 336/234

FOREIGN PATENT DOCUMENTS 209651 12/1956 Australia ..... 336/234

3008598 10/1981 Fed. Rep. of Germany ..... 336/234

*Primary Examiner*—L. Dewayne Rutledge

*Assistant Examiner*—Robert L. McDowell

*Attorney, Agent, or Firm*—Holman & Stern

[57] ABSTRACT

A two-part cut sheet metal lamination element wherein one of the two sheet metal parts 1 comprises two outer legs 3 and a middle leg 4, the other sheet metal part 5 comprises a crosslink, the two outer legs of the first sheet metal part and the crosslink of the second sheet metal part are rigidly attached to each other, and the free end of the middle leg 4 interacts with the crosslink of the second sheet metal part by a short projection 10 which prevents movement of the free end of the middle leg with respect to the corresponding crosslink by an engagement produced when the two sheet metal parts are pressed together, said engagement and immobilization resulting from the punched or stamped configurations of the sheet metal parts. The projection is in the form of a small, narrow projection 10 which may be on the crosslink, and prior to the pressing together of the two sheet metal parts, the projection 10 and the cooperating region 9, 13 of the cooperating region on the middle leg pressed against the projection may or may not have matching configuration and dimensions, so that after the two sheet metal parts are pressed together the middle leg is held securely by means of a press fit or force fit between the projection and cooperating region. A core, e.g., of a transformer or inductor, comprised of such cut sheet metal lamination elements has greatly reduced (mechanical) hum, particularly at relatively high temperatures.

15 Claims, 9 Drawing Figures

CUT SHEET METAL LAMINATION ELEMENT COMPRISED OF TWO PARTS AND HAVING THREE LEGS

BACKGROUND OF THE INVENTION

1. Field of the Invention

The invention relates to a cut sheet metal lamination element for a laminated core of a transformer.

2. Description Of The Prior Art

In a known cut sheet metal lamination element of this type (Ger. OS No. 16 13 628) the projection on the free end of the middle leg is initially the width of the entire middle leg and tapers to a point. It extends into a recess in a crosslink. The dimensions and configurations of the projection and the recess match, even before they are pressed precisely together. The free end of the middle leg is capable of being moved transversely to the plane of the sheet relative to the adjacent crosslink, in particular, when a plurality of cut sheet metal lamination elements are stacked to form a laminated core. This mobility increases with temperature, because the gap between the middle leg and the adjacent crosslink increases with temperature. The mobility is accompanied by substantial (mechanical) hum. Heretofore, the approach to removing this hum has been to introduce adhesive material between the end of the middle leg and the crosslink. Adhesive bonding in this manner has high labor cost, and at high temperatures it frequently loses its effectiveness.

BRIEF SUMMARY OF THE INVENTION

It is therefore an object of the invention to provide a cut sheet metal lamination element of the type described above, wherein mobility of the free end of the middle leg with respect to the corresponding crosslink member is hindered or prevented by pressing together the sheet metal parts, as a result of the configuration of said parts which is produced by the punching or stamping by which the parts are fabricated.

The invention achieves this object by means of an inventive cut sheet metal lamination element characterized in that the projection is in the form of a small, narrow projection, and after the two sheet metal parts are pressed together the middle leg is held securely by means of a press fit or force fit of the projection, whereby the free end of the middle leg is prevented from moving perpendicularly to the plane of said leg.

When the sheet metal parts are pressed together, the region of the projection and the region of the cut sheet metal lamination element which second region is adjacent to said region of the projection are pressed together, and preferably are deformed, thereby ensuring the force fit of the projection and thereby the immobility of the free end of the middle leg. A core comprised of cut sheet metal lamination elements according to the invention distinguishes itself by a sharply lower (mechanical) hum level, particularly at high temperatures.

It is conceivable to provide the projection on the end of the middle leg, and an associated recess on the crosslink member. However, it is particularly advantageous for the projection to be provided on the crosslink, with the associated region, i.e., "cooperating region", of the cut sheet metal lamination element provided on the end of the middle leg. Certain embodiments derived from this arrangement have special advantages.

A particularly advantageous embodiment comprises a crosslink bearing two projections at a distance from each other, which projections press against the respective two corner regions of the free end of the middle leg. In this arrangement no recesses are provided for the projections, but the projections hold the end of the middle leg between them by clamping, with the clamping force exerted over the width of the end of the middle leg.

It is a particularly advantageous variant of the preceding embodiment for the two projections to be furnished with tapering configurations on their mutually facing sides or edges. Thereby the corners of the end of the middle leg may be sharp, or may even be cut further to form projecting points which extend beyond the intersection of the line of the end of the middle leg with the line of the respective perpendicular side of the middle leg. When the two sheet metal parts are pressed together, the points are then deformed by the projections.

It is also particularly advantageous if the cut sheet metal lamination element is employed to produce an alternating laminated core with outwardly directed projections. Useful alternating laminated cores can be manufactured from the inventive cut sheet metal lamination element without disadvantage. Outwardly directed projections are advantageous in pressing together the sheet metal parts, because the crosslink member (I-part) furnished with the projection is often fabricated to be narrower than the crosslink furnished with the outer legs, so that no pressure, or compressive force, needs to be exerted on the narrower crosslink when the two sheet metal parts are pressed together. If two projections at a distance apart are provided, they act particularly well to offset the weakness of the crosslink with the inferior width when the core is pressed together.

If, within the scope of the invention, the projection extends into a recess, the projection and recess may be given a great variety of different shapes. It is particularly advantageous if the projection is truncated and extends into a pointed recess. Such a projection, which may be, e.g., rounded, mates very well under pressure with, i.e., is squeezed very well into, the pointed recess.

It is further particularly advantageous for the recess to be disposed on the center line of the free, or butt, end of the middle leg, wherewith in this embodiment the projection is correspondingly centrally disposed, and the corners of the free end of the middle leg are beveled. When such sheet metal parts are produced by punching or the like, the projection and the bevels of the end of the middle leg are generated simultaneously.

The projection and/or the region of the cut sheet metal lamination element with which the projection cooperates is generally tapered, or conical, so that they slide together readily when the sheet metal parts are pushed together. As a rule, the projections are tapered. If one of the cooperating parts comprises a corner which is deformed when the two sheet metal parts are pressed together, this is advantageous.

If the invention is employed in a transformer core wherein the separation gap between the end of the middle leg and the associated crosslink (I-part) is small, then in a small core the projection may be, e.g., 0.05 to 0.2 mm long, preferably 0.1 to 0.15 mm long, and 1 mm wide, which is only a small fraction of the width of the middle leg.

The invention may also be used in inductors. In this connection, it is particularly advantageous if a pronounced air gap is provided between the free end of the middle leg and the body of the associated crosslink (I-part), and the projections which press against the middle leg and basically hold said leg by clamping, are each disposed on a respective lug or arm which bridges the air gap. The lug or arm is not much longer than the base of the projection is wide and accordingly there is negligible little disturbance of the magnetic properties of the core, while at the same time the mechanical hum is reduced as a result of the invention.

As a rule, the free end of the middle leg, apart from the projection, is pushed flush against the associated crosslink (I-part); however, it is possible for the end of the leg to be disposed in, or integral with, the crosslink. The important consideration is that without the projection and the press-fit of the projection, the free end of the leg would be movable perpendicularly to the plane of the sheet, particularly even in the stacked array. It is conceivable that one sheet metal part be given a U-configuration with the two outer legs, while the other sheet metal part is given a T-configuration; as a rule, however, the invention envisions an EI-configured cut sheet metal lamination element. The crosslink of the one sheet metal part (I-part) may be disposed between the outer legs of the other sheet metal part or against the free ends of the outer legs. The free ends of the outer legs are rigidly attached to the crosslink of the other sheet metal piece by, e.g., interlocking, clamping, adhesive bonding, or particularly advantageously in combination with the invention, welding or brazing.

BRIEF DESCRIPTION OF THE DRAWINGS

Preferred embodiments of the invention will now be described with reference to the accompanying drawings wherein.

DETAILED DESCRIPTION

Figure 1:
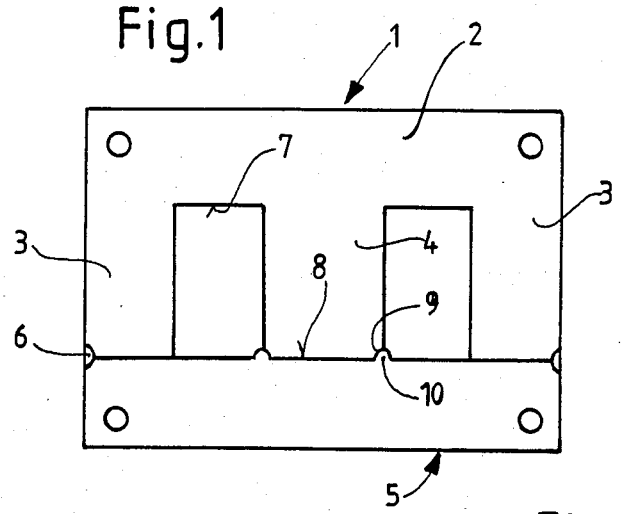
FIG. 1 is an elevational view of a cut sheet metal lamination element comprised of two parts and having three legs.

The cut sheet metal lamination element of FIG. 1 is in the form of an E-I combination with legs of equal length, wherein the I-part extends over the free ends of the three legs. The said element is comprised of an E-shaped part 1 comprising a crosslink 2, two outer legs 3, and a middle leg 4; and the said element is further comprised of an I-shaped part 5 which forms a second crosslink or yoke. The element parts are arranged in two separate stacked arrays, and the I-array is pressed against the E-array. At the contact loci between the I-array and the E-array, a weld is run along a line 6 on each side at the exterior side of the outer leg, to join the parts together. Each element forms a frame around a pair of rectangular openings 7.

The free end of the middle leg 4 contacts the crosslink formed by part 5 at a locus 8 which is essentially a straight line. The two corners 9 of said free end are beveled, and each adjoins a projection 10 provided on the inner side or edge, of the I-part 5. The free end of middle leg 4 is held by compressive force over its width between the two projections 10. By this frictional action, the middle leg 4 of the E-array is prevented from moving perpendicularly to the plane of the sheet, relative to the I-array.

Figure 2:
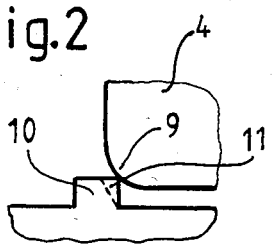
FIG. 2 is an enlarged elevational view of a cutaway portion of a second embodiment of a cut sheet metal lamination element comprised of two parts and having three legs, shown immediately prior to the bringing together of the two parts.
Figure 3:
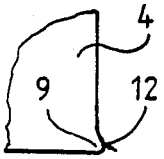
FIG. 3 is an enlarged view of a cutaway portion of a third embodiment of a cut sheet metal lamination element comprised of two parts and having three legs.

In FIG. 2, a middle leg 4 with a previously rounded corner 9 is about to have its free end pressed against a projection 10 which has a sharp corner 11. When this pressing together of the sheet metal parts occurs, the corner 11 is deformed, i.e., the projection 10 adjusts to the rounding of the corner 9. FIG. 3 shows a middle leg which has been cut in advance such that it bears a projecting corner 12 which is intended to undergo deformation in connection with a corresponding conical projection on the other part, when the two sheet metal parts are pressed together.

Figure 4:
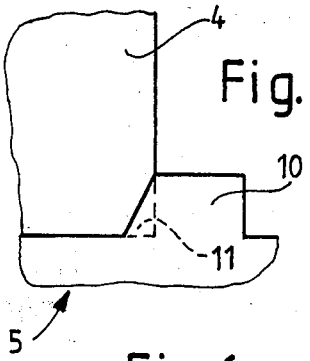
FIG. 4 is an enlarged view of a cutway portion of a fourth embodiment of a cut sheet metal lamination element comprised of two parts and having three legs.

According to FIG. 4, a crosslink part 5 is provided with a projection 10 which is canted on the side of said part which faces a middle leg 4. The middle leg 4 is provided with a distinctly sharp corner 11 which undergoes deformation when the two sheet metal parts are pressed together.

Figure 5:
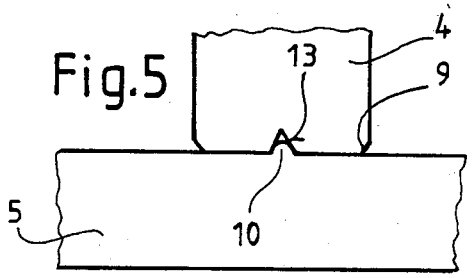
FIG. 5 is an enlarged view of a cutaway portion of a fifth embodiment of a cut sheet metal lamination element comprised of two parts and having three legs.

FIG. 5 shows an embodiment in which only one projection 10 is provided, which projection engages or extends into a recess 13. The projection 10 and the recess are disposed on the center line of the middle leg 4. The recess 13 is sharply pointed, while the projection 10 is truncated. Prior to the pressing together of the two sheet metal parts, the projection is slightly broader than the recess, and after the pressing together the projection is in a condition of being wedged into the recess under elevated frictional forces. The corners 9 of the free end of the middle leg 4 are beveled, the bevels being produced during the punch forming of the corresponding central projection 10, which projection here is disposed on the crosslink 5.

Figure 6:
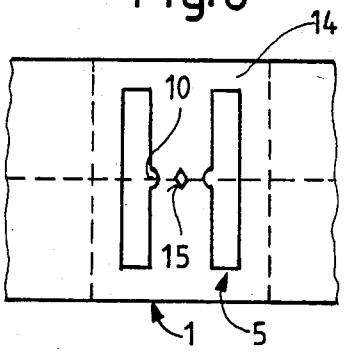
FIG. 6 is a plan view of a segment of a sheet metal strip from which parts of a cut sheet metal lamination element are cut.

FIG. 6 illustrates the stamping of I-parts 5 and E-parts 1 (for the embodiment of FIG. 5) from a single strip of sheet metal 14, whereby one projection and one recess are produced for each cut sheet metal lamination element comprised of two parts. The free end of the middle leg of the E-part lies on the connecting line between two projections 10, in the center of which line a rhomboidal opening 15 is produced in the stamping process; and this opening gives rise to two recesses in the respective middle legs.

Figure 8:
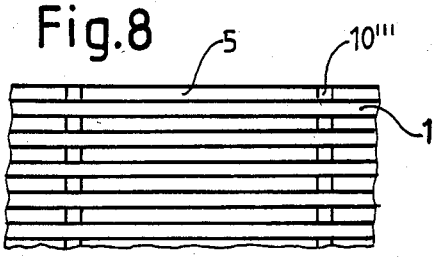
FIG. 8 is a partial, enlarged plan view of a core of a transformer comprised of the parts of a cut sheet metal lamination element according to FIG. 1.

FIG. 8 shows an end face of a core (e.g., of a transformer), wherein the core crosslink on the side facing the viewer alternates between an I-part 5 and the crosslink 2 of an E-part 1. The I-part is furnished on its outer side with two projections 10''' disposed at a distance from each other, which projections project out beyond the outer edge of the E-parts.

Figure 7:
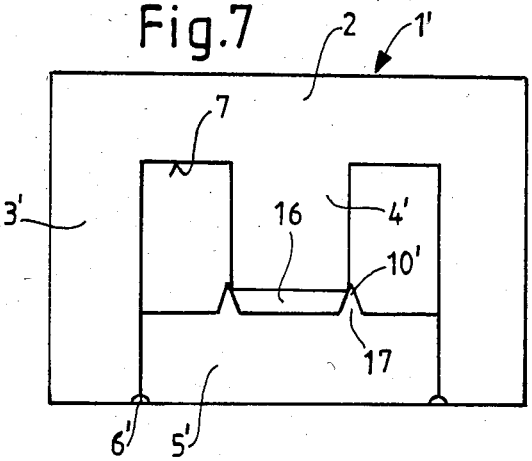
FIG. 7 is an elevational view of a sixth embodiment of a cut sheet metal lamination element comprised of two parts and having three legs.

In the embodiment according to FIG. 7, a shortened I-part 5′ is employed, and the E-part 1′ comprises two elongated outer legs 3′ which accommodate the I-part between them. The two sheet metal parts 1′ and 5′ are joined together by means of two weld seams, or welds 6′ which run between the ends of the I-part and the free ends of the outer legs of the other sheet metal part 1′. A pronounced air gap 16 is provided between the free end of the middle leg 4′ and the associated crosslink 5′. The air gap is of the sort present in the core of an air core inductor. Two lugs 17 are provided on the crosslink 5′, which lugs extend from the inner edge of the crosslink 5′ to the free end of the middle leg 4′. Each lug 17 ends in a projection 10′, and the two projections 10′ hold or accommodate the free end of the middle leg between them, similarly to the situation with the cut sheet metal lamination element of FIG. 1.

Figure 9:
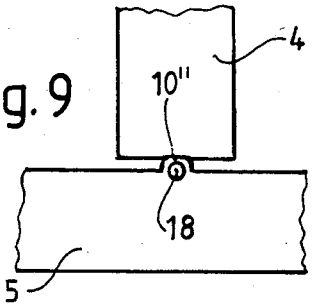
FIG. 9 is an enlarged view of a cutaway portion of a seventh embodiment of a cut sheet metal lamination element comprised of two parts and having three legs.

In the embodiment of FIG. 9 a hole 18 is provided in the crosslink near its inner edge, and the sheet metal region disposed between the hole and said inner edge is bent or expanded outwardly in the form of a projection 10″. When the arrays of laminated core parts, each of which array is comprised of one or more of the two types of sheet metal parts, are pressed together, the outwardly bent sheet metal region 10″ is pressed back until the inner edge of the crosslink and the edge of the free end of the middle leg 4 press against each other. Alternatively, and preferably, the projection here may be provided on the middle leg, i.e., while the hole 18 is still in the I-part 5. It is also possible for the hole 18 to be provided in the middle leg near the free end thereof, and opposite the projection 10″ which remains on the I-part 5.

It is sufficient to achieve the desired result that a press fit be effected wherein the projection presses against a corresponding part under elevated friction. As a rule, however, the projection region and the region of the cut sheet metal lamination element which is pressed against the projection region do not have matching configurations or dimensions. It is sufficient in this regard if either the inner edge of the crosslink or the edge of the middle leg which presses against said inner edge of the crosslink has one or more notches punched in it, whereby the resulting small sawtooth-like projections make impressions in (so as to grip) the edge pressed against them, and are slightly pressed back by said edge.

We claim:

1. In a laminated core comprised of cut sheet metal lamination elements each of which is comprised of two sheet metal parts, with three legs and two crosslinks, the first sheet metal part having two outer legs and a middle leg connected to one of the crosslinks and the second sheet metal part being the other crosslink, the two outer legs of the first sheet metal part and the crosslink of the second sheet metal part are rigidly attached to each other when the two sheet metal parts are pressed together, and the free end of the middle leg of the first sheet metal part interacts with the crosslink of the second sheet metal part by means of an interengaging short projection and a cooperating region, the improvement wherein:

at least one projection is provided in the form of a small, narrow projection on one of said sheet metal parts and at least one cooperating region is provided on the other sheet metal part, said at least one projection and cooperating region having sizes and configurations that do not match but have an interfering fit prior to said pressing together so that after the two sheet metal parts are pressed together the middle leg is held securely by means of a force fit between said at least one projection and cooperating region and deformation of at least one of said projection and cooperating region to prevent the free end of the middle leg from moving perpendicularly to the plane of said middle leg.

2. A cut sheet metal lamination element according to claim 1 wherein;

said at least one projection is provided on the crosslink of the second sheet metal part, and said at least one cooperating region is provided on the end of the middle leg.

3. A cut sheet metal lamination element according to claim 2 wherein;

said at least one projection comprises two projections on the crosslink of said second sheet metal part in spaced relationship with respect to each other, and said at least one cooperating region comprises two corner regions on the free end of said middle leg against which said two projections press.

4. A cut sheet metal lamination element according to claim 3 wherein;

said two projections have tapering configurations on their mutually facing edges.

5. A cut sheet metal lamination element according to claim 2 wherein;

when used to produce an alternating laminated core each crosslink on the second sheet metal part element has at least one projection directed outwardly.

6. A cut sheet metal lamination element according to claim 1 wherein;

said at least one projection is truncated, and said at least one cooperating region comprises a pointed acute angled recess into which said projection extends.

7. A cut sheet metal lamination element according to claim 2 wherein;

said at least one projection is turncated, and said at least one cooperating region comprises a pointed acute angle recess into which said projection extends.

8. A cut sheet metal lamination element according to claim 5 wherein;

said at least one projection is turncated, and said at least one cooperating region comprises a pointed acute angled recess into which said projection extends.

9. A cut sheet metal lamination element according to claim 1 wherein:

said at least one cooperating region and projection are centrally disposed on a line coinciding with the center line of the free end of the middle leg, and said free end of the middle leg has corners which are beveled.

10. A cut sheet metal lamination element according to claim 2 wherein:

said at least one cooperating region and projection are centrally disposed on a line coinciding with the center line of the free end of the middle leg, and said free end of the middle leg has corners which are beveled.

11. A cut sheet metal lamination element according to claim 6 wherein:

said recess and projection are disposed on a line coinciding with the center line of the free end of the middle leg, and said free end of the middle leg has corners which are beveled.

12. A cut sheet metal lamination element according to claim 3 wherein:

a pronounced air gap is provided between the free end of the middle leg and said crosslink of said second sheet metal part, two spaced lugs are provided on said crosslink of said second part to bridge said air gap and form the ends thereof, and said projections are disposed respectively on said lugs to clamp said middle leg.

13. A cut sheet metal lamination element according to claim 4 wherein:

a pronounced air gap is provided between the free end of the middle leg and said crosslink of said second sheet metal part, two spaced lugs are provided on said crosslink of said second part to bridge said air gap and form the ends thereof, and said projections are disposed respectively on said lugs to clamp said middle leg.

14. A cut sheet metal lamination element according to claim 1 and further comprising: a hole provided in the crosslink of the second sheet metal part near the edge thereof which is adjacent to the free end of the middle leg; the sheet metal region between said hole and the free edge of said crosslink is bent outward to form said projection prior to pressing together of the two sheet metal parts; and after said two sheet metal parts are pressed together said sheet metal region is pressed back toward its initial position.

15. A cut sheet metal lamination element according to claim 2 and further comprising: a hole provided in the crosslink of the second sheet metal part near the edge thereof which is adjacent to the free end of the middle leg; and the sheet metal region between said hole and the free edge of said crosslink is bent outward to form said projection prior to pressing together of the two sheet metal parts; and after said two sheet metal parts are pressed together said sheet metal region is pressed back toward its initial position.

* * * * *